US008387931B2

(12) United States Patent
Forrest

(10) Patent No.: US 8,387,931 B2
(45) Date of Patent: Mar. 5, 2013

(54) GRAB BAR ANCHOR ASSEMBLY

(75) Inventor: Earl David Forrest, Asheboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 1008 days.

(21) Appl. No.: 12/032,777

(22) Filed: Feb. 18, 2008

(65) Prior Publication Data

US 2009/0205123 A1 Aug. 20, 2009

(51) Int. Cl.
*F16M 11/00* (2006.01)

(52) U.S. Cl. ..... 248/201; 248/205.1; 248/222.14; 248/251; 4/576.1; 211/105.1

(58) Field of Classification Search ..... 248/251, 248/201, 222.14; 4/576.1; 211/105.1; 174/164, 174/153 A, 168
See application file for complete search history.

(56) References Cited

U.S. PATENT DOCUMENTS

| | | | | |
|---|---|---|---|---|
| 2,311,838 | A * | 2/1943 | Koch | 428/28 |
| 6,019,233 | A * | 2/2000 | Yu | 211/87.01 |
| 6,817,044 | B1 * | 11/2004 | Ouyoung | 4/576.1 |
| 7,958,577 | B2 * | 6/2011 | Chang | 4/610 |
| 7,997,428 | B2 * | 8/2011 | Goldstein | 211/105.3 |

* cited by examiner

*Primary Examiner* — Amy J Sterling
(74) *Attorney, Agent, or Firm* — Carlson, Gaskey & Olds

(57) ABSTRACT

A grab bar is attached to a wall of a shower enclosure with at least one anchor assembly. When installed, a grab bar mount flange covers the anchor assembly from view. The anchor assembly includes a flange collar with a collar bore and a jackscrew that is received within the collar bore. The flange collar is installed within an opening formed within the wall of the shower enclosure. A position of the jackscrew can be adjusted without having to remove the flange collar from the wall. Once properly adjusted, a fastener is inserted through the grab bar mount flange, flange collar, and jackscrew for securement to a wall structure behind the shower enclosure.

15 Claims, 2 Drawing Sheets

GRAB BAR ANCHOR ASSEMBLY

TECHNICAL FIELD

This invention relates to a bar that is utilized in bathrooms, such as a grab bar for example, and more specifically the invention relates to an anchor assembly used to secure the grab bar to a shower enclosure.

BACKGROUND OF THE INVENTION

Grab bars are utilized in bathroom applications to provide support for an individual during exit or entry in a bathtub or shower, for example. Typical grab bars include a body member that is spaced apart from, and parallel to, a wall. The grab bar has end mounts that extend toward the wall such that the grab bar can be mounted to the wall. In one example configuration, the grab bar is mounted to a tub surround or shower enclosure, which can be made from fiberglass, for example. Anchor assemblies are mounted to the shower enclosure, and the end mounts of the grab bar are then attached to the anchor assemblies.

The body member of the grab bar has a wall facing side and a front facing side that is opposite the wall facing side. A projection dimension of the grab bar, i.e. a gap between the wall facing side of the body member and a wall mount surface of the enclosure, is an important feature of an overall grab bar assembly. This projection dimension must be tightly controlled to satisfy industry standards.

Traditional anchor assemblies for grab bars in this type of environment have presented some challenges. For example, during installation of the anchor assembly, it is imported not to compress the fiberglass enclosure as this can lead to cracking. Further, these traditional end mounts have included components such as mounting brackets with wall flanges, threaded spacers, and various fasteners and washers. One disadvantage with traditional designs is that some of the mounting components can fall behind the wall during installation. Another disadvantage is that special tools are often required for installation. Further, wall flange configurations for current anchors can increase the projection dimension when installed, which is undesirable.

Thus, there is a need to provide an anchor assembly for mounting a grab bar to a shower enclosure that can be easily installed without special tools, and which maintains a desired projection dimension, as well as overcoming the other challenges presented by traditional designs discussed above.

SUMMARY OF THE INVENTION

A grab bar is attached to a bathroom structure, such as a wall of a shower enclosure or tub surround for example, with at least one anchor assembly. When installed, mounting structure of the grab bar covers the anchor assembly from view to provide an aesthetically pleasing appearance in addition to maintaining a desired projection dimension.

In one example, the anchor assembly includes a flange collar with a collar bore and a jackscrew that is received within the collar bore. The flange collar is installed within an opening formed within the wall of the shower enclosure. A position of the jackscrew can be adjusted without having to remove the flange collar from the wall. Once properly adjusted, a grab bar mount flange, which is associated with the grab bar, is then attached to the anchor assembly. A fastener is inserted through the grab bar mount flange, flange collar, and jackscrew for securement to a wall structure behind the shower enclosure.

The grab bar includes a front facing side and a wall facing side that is opposite from the front facing side. When the grab bar is secured to a structure such as a wall surface of a shower enclosure made from fiberglass, for example, it is important to tightly control a projection dimension. The projection dimension is defined as a space between the wall facing side of the grab bar and the wall surface.

In one example, the grab bar mount flange includes base portion associated with a wall surface and a post portion extending away from the base portion. A central bore is formed within the grab bar mount flange and extends through the post portion and base portions. A recess is formed within a wall facing side of the base portion. When fully installed, the flange collar is received within this recess, which maintains the desired projection dimension.

The subject anchor assembly for a grab bar provides an easily installed and adjustable configuration that does not adversely affect projection dimensions. These and other features of the present invention can be best understood from the following specification and drawings, the following of which is a brief description.

DETAILED DESCRIPTION OF THE PREFERRED EMBODIMENT

Figure 1:
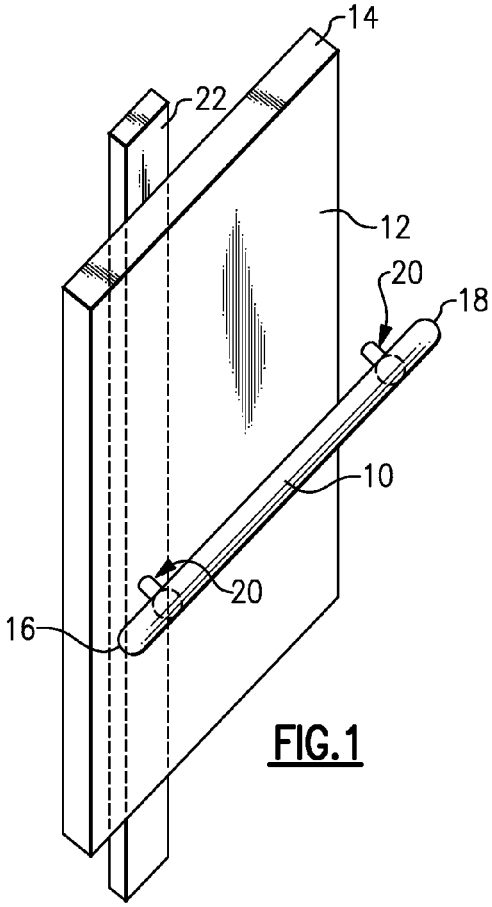
FIG. 1 is a schematic view of a wall structure, enclosure wall, grab bar, and mounting assembly.

A grab bar 10 for attachment to a bathroom wall structure, such as a wall surface 12 of a tub surround/shower enclosure 14 is shown in FIG. 1. In one example, the shower enclosure 14 is made from fiberglass; however other types of materials suitable for bathroom environments could also be used. The grab bar 10 extends between first 16 and second 18 ends. Mounting assemblies 20 are positioned near each of the first 16 and second 18 ends such that the grab bar 10 can be secured to the wall surface 12. In the example shown in FIG. 1, the grab bar 10 is a generally straight configuration; however, the grab bar 10 could include one or more angled portions or could have a non-linear configuration, such as an oval, triangular, or round shape for example. Further, while two mounting assemblies 20 are shown, it should be understood that a single mounting assembly could be used, or additional mounting assemblies could be used, depending upon the overall configuration of the grab bar.

Figure 2:
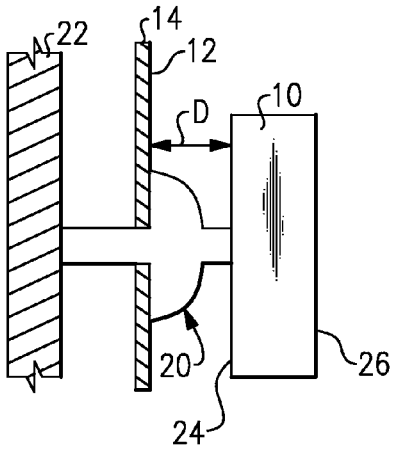
FIG. 2 is a schematic side view showing a projection dimension between an enclosure wall surface and a grab bar.

In one example, the mounting assemblies 20 are aligned with a wall structure 22 spaced behind the shower enclosure 14, such as a wall stud. This ensures secure attachment of the grab bar to the wall structure 22. The grab bar 10 can be made from any of various types of body structures, such as hollow or solid body structures for example, and includes a wall facing side 24 and a front facing side 26 that is opposite the wall facing side 24 (FIG. 2). Each mounting assembly 20 is associated with the wall facing side 24 near the first 16 and second 18 ends as shown; however, the mounting assemblies 20 could be positioned at other locations on the grab bar body itself. When installed, the wall facing side 24 is spaced apart from the wall surface 12 by a projection dimension D as shown in FIG. 2. Industry standards require that this projection dimension D be set and maintained at 1.50 inches (38 millimeters).

Figure 3:
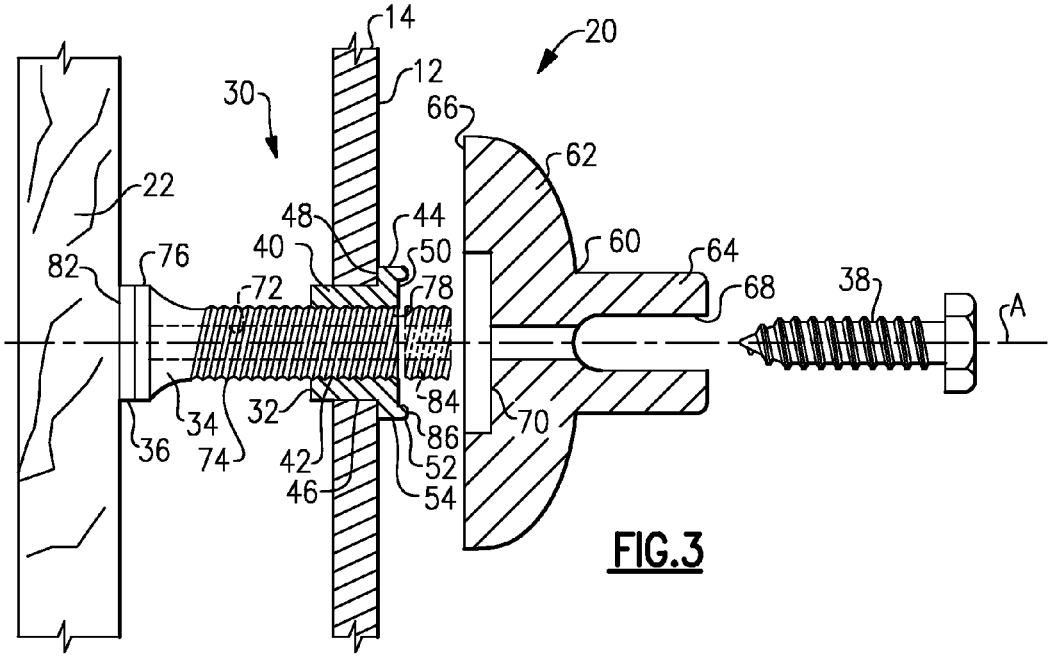
FIG. 3 is a cross-sectional view of an anchor assembly that secures the grab bar to the enclosure wall.

The subject mounting assembly 20 includes an anchor assembly 30, shown in FIG. 3, which provides for easy, adjustable installation without special tools, in addition to providing the desired projection dimension D. In one example, the anchor assembly 30 includes a flange collar 32, a jackscrew 34, a washer 36, and a fastener 38. In one example, the fastener 38 comprises a lag screw sufficient in length to install the grab bar 10 to the jackscrew 34 of the anchor assembly 30. A distal end of the fastener 38 is inserted into the wall structure in a final installation position.

As shown in FIG. 3, the flange collar 32 comprises a body portion 40 defining a collar bore 42 and a flange portion 44 formed about one end of the body portion 40. The body portion 40 is inserted into a wall opening 46 formed within a wall of the shower enclosure 14. The wall opening 46 is aligned with the wall structure 22, i.e. the stud. The collar bore 42 extends entirely through the body portion 40 and is coaxial with the wall opening 46 in the wall. The flange portion 44 includes a wall facing side 48 that abuts against the wall surface 12 of the shower enclosure 14 and a front facing side 50 that is opposite the wall facing side 48.

Figure 4:
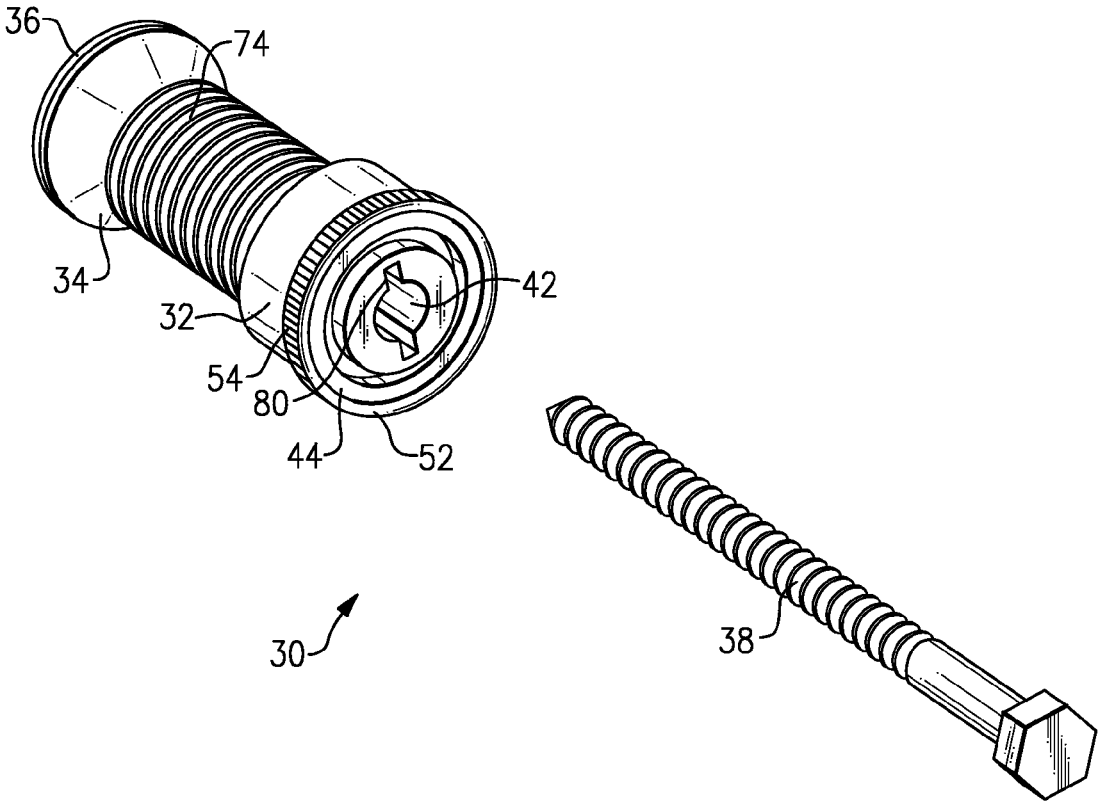
FIG. 4 is a perspective view of the anchor assembly of FIG. 3.

A lip portion 52 is formed about an outer periphery of the flange portion 44. The lip portion 52 extends outwardly toward the grab bar 10 and is generally parallel to a central axis A defined by the wall opening 46. An outer peripheral surface 54 of the lip portion 52, which also corresponds to the outermost peripheral surface of the flange collar 32, comprises a knurled surface as shown in FIG. 4. The knurled surface provides a good gripping surface for an installer such that a position of the jackscrew 34 can be adjusted. This will be discussed in greater detail below.

The mounting assembly 20 also includes a grab bar flange 60 with a base portion 62 and a post portion 64 extending outwardly from the base portion 62. The base portion 62 is of a significantly larger diameter than the post portion 64 and includes a wall facing side 66 that abuts against the wall surface 12. The post portion 64 extends from the base portion 62 toward the grab bar 10. The grab bar flange 60 includes a central bore 68 that is coaxial with the central axis A. The central bore 68 extends entirely through the grab bar flange 60 from the post portion 64 to the base portion 62.

A recess 70 is formed within the base portion 62 that is open to the wall facing side 66. The lip portion 52 of the flange collar 32 is received within this recess 70 in an overlapping relationship. In this mounting position, the wall facing side 66 of the base portion 62 sits flush with the wall surface 12. As such, this configuration hides the anchor assembly 30 completely from view when the grab bar 10 is installed, in addition to maintaining the desired projection dimension D.

The jackscrew 34 includes an internal bore 72 that receives the fastener 38 and includes a threaded outer surface 74. The jackscrew 34 includes a first end 76 and a second end 78, and is threadably received within the collar bore 42 such that a position of the jackscrew 34 can be adjusted relative to the flange collar 32. The first end 76 of the jackscrew 34 is associated with the wall structure 22 and the second end 78 is associated with the flange collar 32.

The washer 36 is associated with the first end 76 of the jackscrew 34. The washer 36 is securely attached to the jackscrew 34 to ensure that the washer 36 will not fall off during installation. The washer 36 can be press-fit or insert-molded on the jackscrew 34, for example; however, other securement methods could also be used.

The jackscrew 34 has an initial length that is greater than a final installed length. During installation, an assembly of the washer 36, jackscrew 34, and flange collar 32 is inserted through the wall opening 46 until the flange collar 32 abuts against the wall surface 12. An installer holds the flange collar 32 fixed by gripping the outer peripheral surface 54 of the lip portion 52, and then rotates the jackscrew 34 into a proper installation position, with the wall facing side of the flange collar 32 being in contact with the wall surface 12.

To facilitate this installation step, a tool feature 80 is formed within an end face of the jackscrew 34, as shown in FIG. 4. In one example, the tool feature 80 comprises a slot that is configured to receive a screwdriver. The slot overlaps the internal bore 72 of the jackscrew 34. While the installer holds the flange collar 32 stationary, the screwdriver is inserted into the tool feature 80 and the jackscrew 34 is then rotated to adjust the position of the jackscrew 34. The jackscrew 34 is rotated until an abutment surface 82 on the washer 36 contacts the wall structure 22. The flange collar 32 ensures that the jackscrew 34 will not fall behind the wall during installation. Additionally, the jackscrew 34 is adjusted relative to the flange collar without compressing the wall of the shower enclosure 14, which reduces the potential for cracking.

Once the washer 36 contacts the wall structure, a mark is placed on the jackscrew 34 to identify a portion 84 of the jackscrew 34 that is to be cut off. A cut-off indicator 86, such as a marking for example, is formed on the flange collar 32. When the washer 36 contacts the wall structure, the cut-off indicator 86 indicates where the jackscrew 34 should be cut. The mark is made, and then the jackscrew 34, washer 36, and flange collar 32 are removed from the wall opening 36. The jackscrew 34 is then cut at the mark to remove the portion 84 of the jackscrew 34 that is not needed. The washer 36, jackscrew 34, and flange collar 32 are then re-inserted through the wall opening 46 as a unit.

Next, the grab bar flange 60 of the grab bar 10 is fit over the flange collar 32 such that the lip portion 52 is received within the recess 70. The fastener 38 is then used to secure the assembly in place. The fastener 38 is inserted through the central bore of the grab bar flange 60 and into the internal bore of the jackscrew 34 of the anchor assembly 30 to engage into the wall structure 22. The washer 36, which is tightly fitted into the back of the jackscrew 34, helps to spread compressive loads evenly over the entire surface of the anchor assembly 30.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An anchor assembly for a bathroom grab bar comprising:

a flange collar having a collar bore and a flange portion formed about said collar bore, said flange portion being associated with a grab bar mount component, and wherein said flange collar has a first end to face the grab bar mount component and a second end to face a wall structure with said flange portion being formed about said first end;

a jackscrew having an internal bore and a threaded outer surface received within said collar bore, said jackscrew having a first end that is to be associated with the wall structure and a second end that is associated with said flange collar; and a fastener inserted within said internal bore.

2. The anchor assembly for a bathroom grab bar according to claim 1 including a washer associated with said first end of said jackscrew, said washer including an abutment surface to contact the wall structure.

3. The anchor assembly for a bathroom grab bar according to claim 2 including one of a press-fit interface or insert-molded interface between said jackscrew and said washer.

4. An anchor assembly for a bathroom grab bar comprising:

a flange collar having a collar bore and a flange portion formed about said collar bore, said flange portion being associated with a grab bar mount component;

a jackscrew having an internal bore and a threaded outer surface received within said collar bore, said jackscrew having a first end that is to be associated with a wall structure and a second end that is associated with said flange collar, and wherein said jackscrew has an initial length with said second end extending outwardly from said flange collar when initially mounted to a wall surface of a shower enclosure, and has a final length shorter than said initial length when the grab bar mount component is finally mounted to the wall surface; and a fastener inserted within said internal bore.

5. The anchor assembly for a bathroom grab bar according to claim 4 wherein said flange collar includes a cut-off indicator that is used to define said final length.

6. An anchor assembly for a bathroom grab bar comprising:

a flange collar having a collar bore and a flange portion formed about said collar bore, said flange portion being associated with a grab bar mount component;

a jackscrew having an internal bore and a threaded outer surface received within said collar bore, said jackscrew having a first end that is to be associated with a wall structure and a second end that is associated with said flange collar, and wherein said second end of said jackscrew includes a tool feature to receive a tool such that said flange collar is held fixed while the tool adjusts a position of said jackscrew by rotating said jackscrew relative to said flange collar; and a fastener inserted within said internal bore.

7. The anchor assembly for a bathroom grab bar according to claim 6 wherein said tool feature comprises a slot formed within an end face of said jackscrew, and wherein the tool comprises a screwdriver to be received within said slot.

8. An anchor assembly for a bathroom grab bar comprising:

a flange collar having a collar bore and a flange portion formed about said collar bore, said flange portion being associated with a grab bar mount component, and wherein said flange portion of said flange collar includes a wall facing side to abut against a wall mount surface of a shower enclosure and a front facing side facing opposite said wall facing side, said flange portion including an outwardly extending lip formed about an outer periphery of said flange portion and extending in a direction toward the grab bar mount component;

a jackscrew having an internal bore and a threaded outer surface received within said collar bore, said jackscrew having a first end that is to be associated with a wall structure and a second end that is associated with said flange collar; and a fastener inserted within said internal bore.

9. The anchor assembly for a bathroom grab bar according to claim 8 wherein the grab bar mount component comprises a grab bar mount flange and wherein said outwardly extending lip is to be received within a recess formed within a wall facing side of the grab bar mount flange such that said flange collar is hidden from view when the grab bar mount flange is installed.

10. The anchor assembly for a bathroom grab bar according to claim 1 wherein an outermost peripheral surface of said flange portion of said flange collar comprises a knurled surface.

11. The anchor assembly for a bathroom grab bar according to claim 2 wherein said flange collar is rotationally fixed and said jackscrew is rotated relative to said flange collar until said abutment surface contacts the wall structure.

12. The anchor assembly for a bathroom grab bar according to claim 1 wherein said flange portion has a bar facing side and a wall facing side that is configured to abut against an enclosure wall spaced from the wall structure.

13. The anchor assembly for a bathroom grab bar according to claim 1 wherein the grab bar mount component comprises a base portion and a post portion extending outwardly from the base portion in a direction toward the grab bar.

14. The anchor assembly for a bathroom grab bar according to claim 13 wherein said base portion includes a recess that receives said flange portion.

15. The anchor assembly for a bathroom grab bar according to claim 14 wherein said base portion is configured to abut against an enclosure wall spaced from the wall structure.

* * * * *